US009771816B2

(12) United States Patent
Weber

(10) Patent No.: US 9,771,816 B2
(45) Date of Patent: Sep. 26, 2017

(54) BLADE COOLING CIRCUIT FEED DUCT, EXHAUST DUCT, AND RELATED COOLING STRUCTURE

(71) Applicant: General Electric Company, Schenectady, NY (US)

(72) Inventor: David Wayne Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 486 days.

(21) Appl. No.: 14/271,823

(22) Filed: May 7, 2014

(65) Prior Publication Data

US 2015/0322802 A1 Nov. 12, 2015

(51) Int. Cl.

| | |
|---|---|
| ***F01D 5/18*** | (2006.01) |
| ***F01D 9/06*** | (2006.01) |
| ***F01D 25/12*** | (2006.01) |

(52) U.S. Cl.

CPC ..... *F01D 9/065* (2013.01); *F01D 5/187* (2013.01); *F01D 25/12* (2013.01); *F05D 2240/81* (2013.01); *F05D 2250/292* (2013.01); *F05D 2260/201* (2013.01)

(58) Field of Classification Search

CPC ..... F01D 5/187; F01D 2260/201
USPC ..... 416/95, 96 R
See application file for complete search history.

(56) References Cited

U.S. PATENT DOCUMENTS 2,779,565 A * 1/1957 Bruckmann ..... F01D 5/087 415/200
3,885,609 A 5/1975 Frei et al.
3,989,412 A 11/1976 Mukherjee
4,288,201 A 9/1981 Wilson
4,962,640 A 10/1990 Tobery
5,320,485 A 6/1994 Bourguignon et al.
5,344,283 A 9/1994 Magowan et al.
5,387,085 A 2/1995 Thomas, Jr. et al.

(Continued)

FOREIGN PATENT DOCUMENTS

EP 2407639 A1 1/2012
EP 2469034 A2 6/2012

OTHER PUBLICATIONS

U.S. Appl. No. 14/288,976, Office Action 1 dated Aug. 12, 2016, 28 pages.

(Continued)

*Primary Examiner* — Kevin Murphy

(74) *Attorney, Agent, or Firm* — Ernest G. Cusick; Hoffman Warnick LLC

(57) ABSTRACT

A blade cooling circuit feed and exhaust duct and related cooling structure are provided. The feed duct may include a feed chamber having a feed entrance fluidly coupled to a cooling fluid source and a feed exit to an elongate entrance to the cooling circuit, the feed exit including a ramped wall maintaining a flow velocity of the cooling fluid along the elongated entrance to the cooling circuit. The exhaust duct may include a substantially concave exhaust chamber including an exhaust entrance at a wider end of the exhaust chamber and in fluid communication with an elongated exit from the cooling circuit, and an exhaust exit at a narrower end of the exhaust chamber, the exhaust exit including an opening to an exhaust passageway from the exhaust chamber.

13 Claims, 3 Drawing Sheets

(56) References Cited

U.S. PATENT DOCUMENTS

| | | | | |
|---|---|---|---|---|
| 5,387,086 | A * | 2/1995 | Frey | F01D 5/187 416/96 R |
| 5,630,700 | A | 5/1997 | Olsen et al. | |
| 5,772,398 | A | 6/1998 | Noiret et al. | |
| 5,954,475 | A | 9/1999 | Matsuura et al. | |
| 5,997,245 | A | 12/1999 | Tomita et al. | |
| 6,036,436 | A | 3/2000 | Fukuno et al. | |
| 6,065,928 | A | 5/2000 | Rieck, Jr. et al. | |
| 6,126,396 | A | 10/2000 | Doughty et al. | |
| 6,142,730 | A | 11/2000 | Tomita et al. | |
| 6,428,270 | B1 | 8/2002 | Leone et al. | |
| 6,615,574 | B1 | 9/2003 | Marks | |
| 6,761,529 | B2 | 7/2004 | Soechting et al. | |
| 7,204,675 | B2 | 4/2007 | Texier | |
| 7,625,172 | B2 | 12/2009 | Walz et al. | |
| 7,686,581 | B2 | 3/2010 | Brittingham et al. | |
| 7,785,067 | B2 | 8/2010 | Lee et al. | |
| 7,967,567 | B2 | 6/2011 | Liang | |
| 8,011,881 | B1 | 9/2011 | Liang | |
| 8,079,814 | B1 | 12/2011 | Liang | |
| 8,096,767 | B1 | 1/2012 | Liang | |
| 8,096,772 | B2 | 1/2012 | Liang | |
| 8,100,654 | B1 | 1/2012 | Liang | |
| 8,231,329 | B2 | 7/2012 | Benjamin et al. | |
| 8,292,573 | B2 | 10/2012 | Broomer et al. | |
| 8,353,669 | B2 | 1/2013 | Chon et al. | |
| 8,356,978 | B2 | 1/2013 | Beattie et al. | |
| 8,439,643 | B2 | 5/2013 | Kuhne et al. | |
| 9,021,816 | B2 | 5/2015 | Bergman et al. | |
| 9,254,537 | B2 | 2/2016 | Li et al. | |
| 2007/0160475 | A1 | 7/2007 | Rogers et al. | |
| 2010/0129196 | A1 | 5/2010 | Johnston et al. | |
| 2010/0129199 | A1 | 5/2010 | Davis | |
| 2010/0239432 | A1 | 9/2010 | Liang | |
| 2011/0058957 | A1 | 3/2011 | Von Arx et al. | |
| 2011/0189000 | A1 | 8/2011 | Vedhagiri et al. | |
| 2013/0004295 | A1 | 1/2013 | Naryzhny et al. | |
| 2013/0028735 | A1 | 1/2013 | Burt et al. | |
| 2014/0000285 | A1 | 1/2014 | Bergman et al. | |

OTHER PUBLICATIONS

U.S. Appl. No. 14/288,976 Final Office Action 1 dated Dec. 19, 2016, 31 pages.

U.S. Appl. No. 14/288,976, Notice of Allowance dated Mar. 20, 2017, 10 pages.

U.S. Appl. No. 14/801,187, Notice of Allowance dated Jul. 5, 2017, 41 pages.

* cited by examiner

BLADE COOLING CIRCUIT FEED DUCT, EXHAUST DUCT, AND RELATED COOLING STRUCTURE

BACKGROUND OF THE INVENTION

The disclosure relates generally to blades, and more particularly, to a cooling circuit feed duct, a cooling circuit exhaust duct, and a related cooling structure.

Blades are used in turbine applications to direct hot gas flows and generate power from the gas flows. For example, in steam and gas turbine applications, stationary blades are referred to as nozzles, and are mounted to an exterior structure such as a casing and/or an internal seal structure by endwalls. Each endwall couples to an end of the airfoil of the blade.

In order to operate in extreme temperature settings, the airfoil and endwalls need to be cooled. For example, in some settings, a cooling fluid is pulled from a cooling fluid source in the form of the wheel space and directed to internal end walls for cooling. In contrast, in many gas turbine applications, later stage nozzles may be fed cooling fluid, e.g., air, extracted from a source such as a compressor. Outer diameter endwalls receive the cooling fluid directly, while inner diameter endwalls receive the cooling fluid after it is routed through the airfoil from the outer diameter. For example, this routing may be performed by passing the cooling fluid through an impingement insert (also known as a baffle) within a core passage of the airfoil and into a pressurized diaphragm that is separate from and positioned radially internal from the endwall. Once the cooling fluid is in the diaphragm, the cooling fluid is directed radially outward to a cooling circuit in the endwall. The endwall cooling circuit can take a variety of forms such as a pin-pedestal arrangement, an impingement arrangement and/or serpentine passage in the endwall that directs the cooling fluid to necessary portions of the cores thereof. One challenge relative to cooling circuits is ensuring the cooling fluid flow reaches all regions of the cooling circuit, e.g., corners of the circuit, and does not stagnate with inactive velocity.

BRIEF DESCRIPTION OF THE INVENTION

A first aspect of the disclosure provides a cooling fluid feed duct for a cooling circuit of a blade, the cooling fluid feed duct comprising: a chamber including an entrance fluidly coupled to a cooling fluid source and an exit fluidly coupled to an elongate entrance to the cooling circuit, the exit including a ramped wall substantially maintaining a flow velocity of the cooling fluid along the elongated entrance to the cooling circuit.

A second aspect of the disclosure provides a cooling fluid exhaust duct for a cooling circuit of a blade, the cooling fluid exhaust duct comprising: a substantially concave chamber including an entrance at a wider end of the chamber and fluidly coupled with an elongated exit from the cooling circuit, and an exit at a narrower end of the chamber, the exit including an opening to an exhaust passageway from the substantially concave chamber.

A third aspect of the disclosure provides a cooling structure for a blade, the cooling structure comprising: a cooling circuit in a portion of the blade; a cooling fluid feed duct for the cooling circuit, the cooling fluid feed duct including a feed chamber having a feed entrance fluidly coupled to a cooling fluid source and a feed exit to an elongate entrance to the cooling circuit, the feed exit including a ramped wall maintaining a flow velocity of the cooling fluid along the elongated entrance to the cooling circuit; and a cooling fluid exhaust duct for the cooling circuit, the cooling fluid exhaust duct including a substantially concave exhaust chamber including an exhaust entrance at a wider end of the exhaust chamber and in fluid communication with an elongated exit from the cooling circuit, and an exhaust exit at a narrower end of the exhaust chamber, the exhaust exit including an opening to an exhaust passageway from the exhaust chamber.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated above, the disclosure provides a cooling fluid feed duct and a cooling fluid exhaust duct for a cooling circuit of a blade. The ducts may be used alone or in combination. In the latter case, they may be employed as part of a cooling structure including a cooling circuit and the two ducts.

Figure 1:
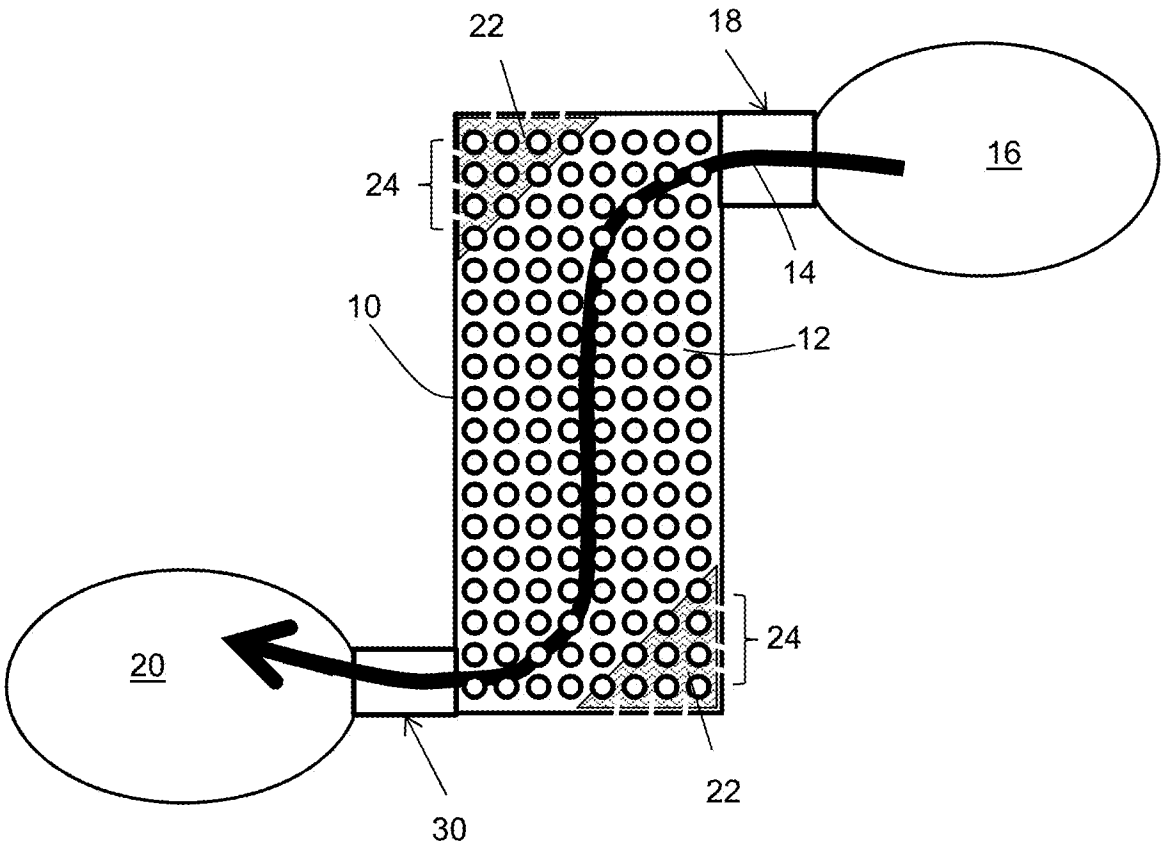
FIG. 1 PRIOR ART
FIG. 1 shows a schematic plan view of an arrangement of a cooling structure and related feed and exhaust ducts.

As noted, one challenge relative to cooling circuits is ensuring the cooling fluid flow reaches all regions of the cooling circuit, e.g., corners of the circuit, and does not stagnate with inactive velocity. To illustrate, FIG. 1 shows a plan view of a simplified arrangement in which a cooling circuit 10 includes internal core passages 12 (e.g., formed by a pin-pedestal arrangement). Cooling circuit 10 is fed a cooling fluid 14 (think arrowed line), e.g., air, from a source 16 at a single location via a passage or hole(s) 18, which is typically in a corner of the cooling circuit. Cooling fluid 14 exits the cooling circuit to a cooling sink 20. Passage or hole(s) 18 are oriented generally parallel to core passages 12, i.e., in the plane of the page. In many cases, this arrangement optimizes the chance that cooling fluid fully fills, i.e., reaches all extremities, of cooling circuit 10 without any stagnant volumes. But, in some cooling circuits, e.g., those in nozzle endwalls which may be oddly shaped, the conventional arrangement creates stagnant volumes 22 (shown as triangles in corners of circuit 10) in which cooling fluid is inactive. Stagnant volumes 22 create overheating. In order to activate the stagnant corners, cooling fluid 14 may be pulled through drilled holes 24 in cooling circuit 10 and dumped to the exterior of the circuit. Alternatively, more than one feed passage may be employed to feed cooling fluid to those areas susceptible to stagnation. If a goal is to use the used cooling fluid flow to purge or cool a downstream cooling circuit, then this cooling fluid flow is lost, decreasing overall engine efficiency.

In addition to the above-noted challenges, cooling circuit 10 is generally exhausted through an array of passages or holes (film, endwall mate-face)(not shown). This arrangement usually allows cooling circuit 10 to be free of stagnant volumes 22 near its termination because the flow is pulled off evenly. But, again, if the goal is to use the entirety of the heat capacity of cooling fluid 14 that passes through the cooling circuit 10 for purge or cooling of another circuit, then it may be necessary to pull the flow off at a single location 30, as illustrated. If the flow is exited at a lateral side of cooling circuit 10, stagnant volumes 22 will be present and extra flow required to activate those volumes, e.g., via drilled holes 24.

Figure 2:
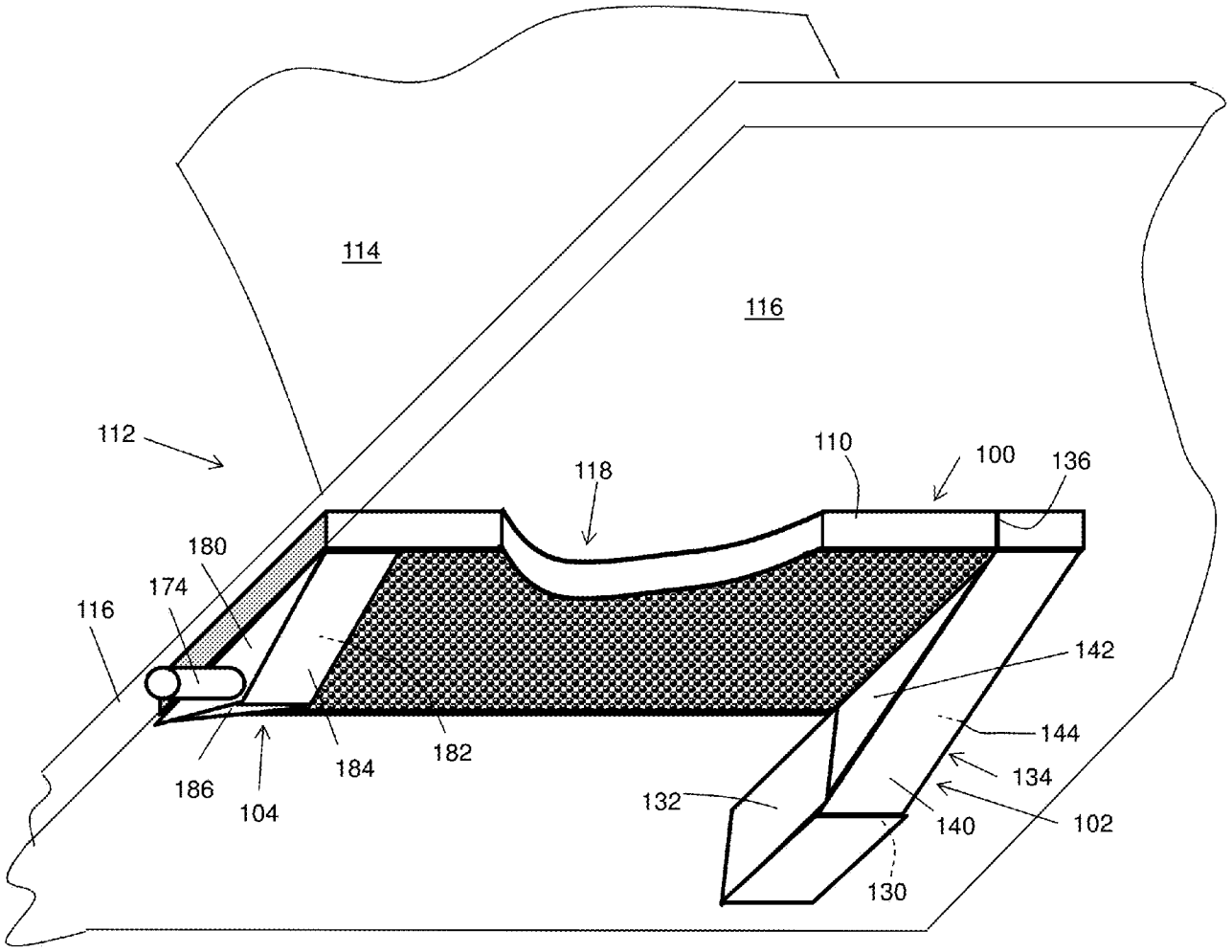
FIG. 2 shows a schematic bottom perspective view of one embodiment of cooling circuit feed and exhaust ducts and a related cooling structure.

Referring to FIG. 2, a schematic bottom perspective view of one embodiment of a cooling structure 100 including a cooling circuit feed duct 102 and a cooling circuit exhaust duct 104 is illustrated. Cooling structure 100 includes a cooling circuit 110 in an endwall 116 of a stationary blade 112. Although the teachings of the disclosure will be described relative to a stationary blade, it is understood that they are equally applicable to a moving blade. Only a small portion of blade 112 is shown including portions of an airfoil 114 and endwall 116 thereof. Cooling circuit 110 can be any form of cooling circuit such as but not limited to: an impingement system, a pin-pedestal arrangement (shown) and/or a serpentine passage. As illustrated, cooling circuit 110 is formed in endwall 116 of blade 112; however, the circuit can be positioned anywhere in blade 112.

In any event, a cooling fluid is directed through cooling circuit 110 to cool the portion of blade 112 in which the cooling circuit is positioned. To this end, cooling circuit 110 can take a large variety of shapes to accommodate cooling of particular areas. The example circuit shown in FIG. 2 is generally rectangular with a rounded cut out portion 118 that could surround another part (not shown) such as a pressurized diaphragm, a cooling fluid passage, an end of airfoil 114, etc. In contrast, in FIG. 3, in a schematic plan view, a cooling circuit 110 is shown as rectangular for simplification of description. It is noted that a rectangularly shaped circuit is relatively rare in most settings. As understood, a cooling fluid 120 (thin lines in FIGS. 3-5) is passed through cooling circuit 110 to cool the part in which it is positioned; in this example, a portion of endwall 116. As shown schematically in FIG. 3, cooling fluid 120 may be supplied to cooling circuit 110 from a cooling fluid source 124, which may include any now known or later developed manner of supplying a cooling fluid. For example, cooling fluid 120 may be provided from a source including but not limited to: a pressurized diaphragm radially inward of blade 112 (FIG. 2), a chamber(s) that receives cooling fluid from an impingement insert within airfoil 114 (FIG. 2) or directly from a core passage (not shown) within the airfoil, another cooling circuit within endwall 116 (FIG. 2), a wheel space, etc. As also shown schematically in FIG. 3, once through cooling circuit 110, used cooling fluid 126 may be directed to a cooling sink 128. Cooling sink 128 may include any downstream structure capable of using used cooling fluid 126 efficiently such as but not limited to: a pressurized diaphragm radially inward of blade 112 (FIG. 2), another cooling circuit within endwall 116 (FIG. 2), a wheel space, etc.

Figure 4:
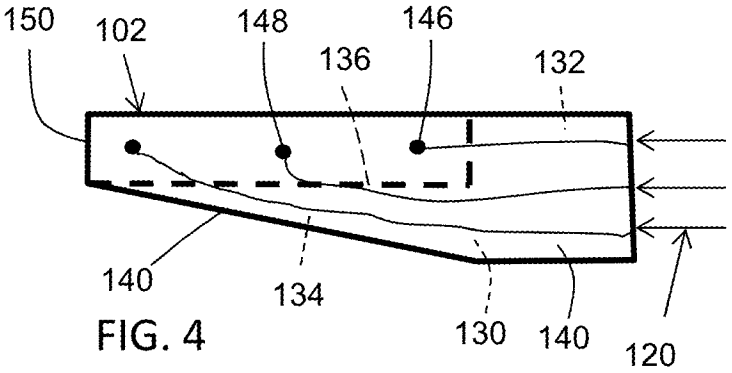
FIG. 4 shows a schematic side view of one embodiment of a feed duct.
Figure 3:
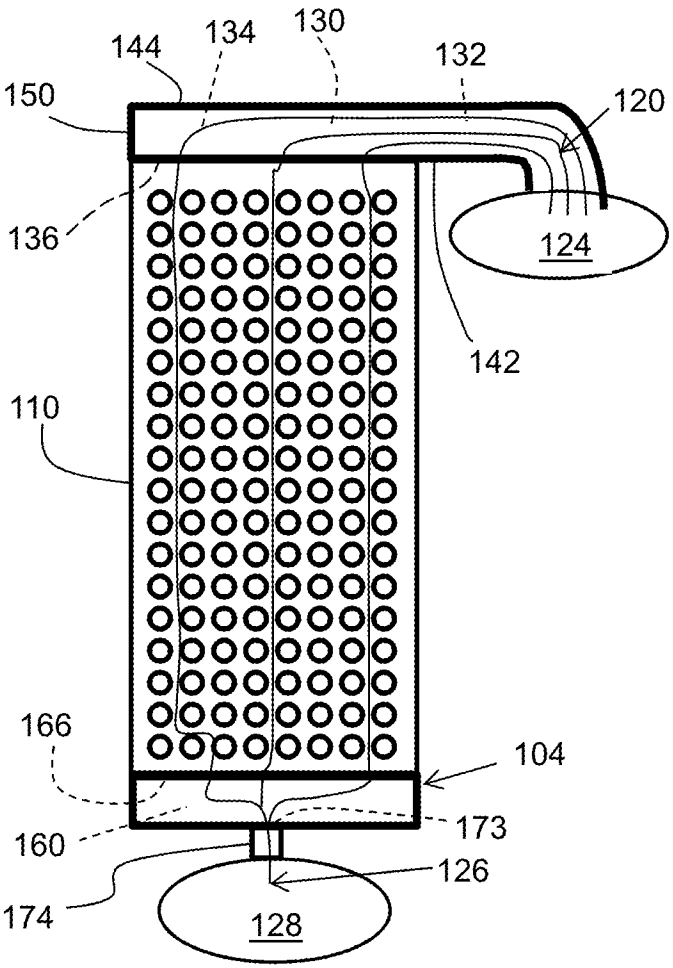
FIG. 3 shows a schematic plan view of one embodiment of cooling circuit feed and exhaust ducts and a related cooling structure.

Turning to FIGS. 2-4 collectively, cooling fluid feed duct 102 for cooling circuit 110 of blade 112 may include a chamber 130 including an entrance (feed entrance) 132 fluidly coupled to cooling fluid source 124 (FIG. 2 only) and an exit (feed exit) 134 fluidly coupled to an elongate entrance 136 (FIGS. 3 and 4) to cooling circuit 110. Elongated entrance 136 to cooling circuit 110 is larger than any conventional opening from a passage or holes 18 (FIG. 1), and is preferably positioned such that it is substantially aligned with an expected cooling fluid 120 flow direction through cooling circuit 110 (e.g., vertically downward on page in FIG. 3, right to left in FIG. 2). The cooling fluid flow direction may be a general direction in which cooling fluid flows through circuit 110 and reaches most, if not all, of the surface area. It is understood that cooling fluid 120 may not flow in a laminar fashion through circuit 110 as it engages the various heat transfer elements therein. For example, the pins in a pin-pedestal arrangement, as illustrated in FIG. 3.

In contrast to entrance 132, exit 134 includes a ramped wall 140 (FIGS. 2 and 4) substantially maintaining a flow velocity of cooling fluid 120 along elongated entrance 136 to cooling circuit 110. As shown in FIGS. 2 and 3, chamber 130 includes a pair of opposing side walls 142, 144 and ramped wall 140 extends between the pair of opposing side walls. As cooling fluid 120 enters chamber 130, it has a particular mass flow and flow velocity in entrance 132. As it progresses along elongated entrance 136, the flow velocity decreases as cooling fluid mass flow progresses into cooling circuit 110, e.g., through flow path openings 146, 148 in FIG. 4. In order to maintain flow velocity, ramped wall 140 acts to decrease the volume of chamber 130 towards an end 150 thereof. In other words, entrance 132 has a first cross-sectional area and exit 134 has a decreasing cross-sectional area from entrance 132 to end 150 of the exit. In addition, as shown best in FIG. 3, exit 134 of chamber 130 directs cooling fluid 120 exiting therefrom to substantially align with a substantially linear flow direction of cooling fluid 120 through cooling circuit 110. As a result of the afore-described structure, feed duct 102 more evenly distributes cooling fluid 120 within cooling circuit 110, substantially reducing or eliminating stagnant volumes.

Figure 5:
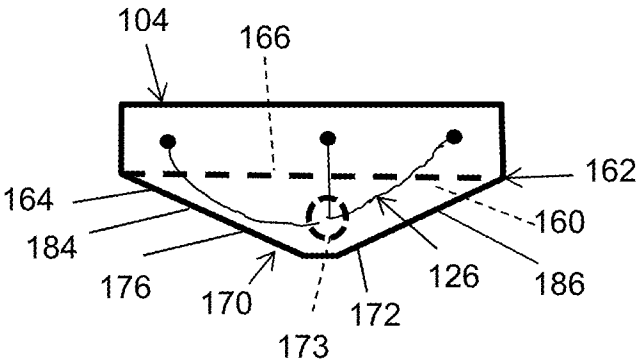
FIG. 5 shows a schematic side view of one embodiment of an exhaust duct.

Referring to FIGS. 2, 3 and 5, cooling fluid exhaust duct 104 includes a substantially concave chamber 160 including an entrance (exhaust entrance) 162 at a wider end 164 of the (exhaust) chamber and fluidly coupled with an elongated exit 166 from cooling circuit 110. Elongated exit 166 from cooling circuit 110 is larger than a typical conventional passage (at location 30 in FIG. 1), and is preferably positioned such that it is substantially aligned with an expected cooling fluid 120 flow direction through cooling circuit 110 (e.g., vertical on page in FIG. 3, right to left in FIG. 2). Exhaust duct 102 also includes an exit 170 at a narrower end 172 of chamber 160. Exit 170 includes an opening 173 to an exhaust passageway 174 (FIG. 2) from substantially concave chamber 160, e.g., to a cooling fluid sink 128 (FIG. 3). As can be observed in FIG. 5, (exhaust) entrance 162 has a first cross-sectional area and (exhaust) exit 170 has a decreasing cross-sectional area from entrance 162 to an end 176 of the exit. Chamber 160 may include a pair of opposing side walls 180, 182 (FIG. 4), and a pair of opposing ramped walls 184, 186 extending between the pair of opposing side walls. In the example shown, opposing ramped walls 184, 186 create the substantial concave nature of chamber 160. In FIG. 5, opposing ramped walls 184, 186 are illustrated connected by a small connecting wall (below opening 172); however this wall is not necessary. Although substantially concave chamber 160, as described, has been created with opposing ramped walls 184, 186, it is understood that a variety of other structures could be used to create the concave nature. For example, a single curved wall could be used.

In operation, entrance 162 of chamber 160 directs used cooling fluid 126 entering thereto in substantial alignment with a substantially linear flow direction of cooling fluid 126 through the cooling circuit (e.g., vertically downward on page in FIG. 3, right to left in FIG. 2). That is, entrance 162 acts to gather the flow from an entire width of circuit 110 and concentrate it on a single exit opening 172, thus reducing or eliminating stagnant volumes near the enlarged exit 166 of circuit 110.

As shown best in FIGS. 2 and 4, both chamber 130 of feed duct 102 and chamber 160 of exhaust duct 104 extend away from a plane of cooling circuit 110. In the examples illustrated, chamber 160 extends radially inward from endwall 116 (shown downward here); however, in other settings this may not be the case. In any event, in this fashion, the effective cooling area of cooling circuit 110 is not diminished by either duct even though chamber(s) 130 and/or 160 is/are present. Ducts 102, 104 can be coupled to cooling circuit 110 in their entirety, or cooling circuit 110 can provide part of or engage with ducts 102, 104.

Each duct 102, 104 may be made of any suitable material, e.g., cast steel, sheet metal material, etc.

The ducts, individually and collectively, act to diffuse cooling fluid flow when it is not possible to feed and exhaust cooling circuits substantially parallel to the cooling circuit. Further, the duct(s) allow for a robust cooling design without the need for additional cooling fluid flow to mitigate stagnant volumes in the cooling circuit, which leads to a higher engine efficiency and a lower heat rate. Moreover, the duct(s) allow the utilization of an endwall leading edge cooling circuit with a single feed and exhaust location, reducing the complexity, cost and inefficiency associated with multiple feed/exhaust locations for that location and others. A single exhaust location can provide the spent flow for reuse, such as purge or another downstream cooling scheme.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A cooling fluid feed duct for a cooling circuit of a blade, the cooling fluid feed duct comprising:

a chamber including:

an entrance fluidly coupled to a cooling fluid source; and an exit fluidly coupled to an elongated entrance to the cooling circuit, wherein the elongated entrance to the cooling circuit includes a plurality of flow path openings for directing the cooling fluid from the elongated entrance into the cooling circuit, wherein the plurality of flow path openings direct the cooling fluid into the cooling circuit along an axis substantially perpendicular to an axis of the chamber; and wherein the exit of the chamber includes a linear ramped wall for maintaining a flow velocity of the cooling fluid along the elongated entrance to the cooling circuit as the cooling fluid passes from the exit of the chamber into the cooling circuit through the plurality of flow path openings, wherein the ramped wall extends at least from a first end of the elongated entrance to a second end of the elongated entrance, and wherein a distance from the ramped wall to a far side of the elongated entrance decreases in a direction of flow of the cooling fluid along the elongated entrance through the exit of the chamber.

2. The cooling fluid feed duct of claim 1, wherein the entrance has a first cross-sectional area and the exit has a decreasing cross-sectional area from the entrance to an end of the exit.

3. The cooling fluid feed duct of claim 1, wherein the chamber includes a pair of opposing side walls and the ramped wall extends between the pair of opposing side walls.

4. The cooling fluid feed duct of claim 1, wherein the exit of the chamber directs the cooling fluid exiting therefrom through the plurality of flow path openings to substantially align with a substantially linear flow direction of the cooling fluid through the cooling circuit.

5. A cooling fluid exhaust duct for a cooling circuit of a blade, the cooling fluid exhaust duct comprising:

a substantially concave chamber, including:

an entrance at a wider end of the chamber and fluidly coupled with an elongated exit from the cooling circuit, the elongated exit from the cooling circuit including a plurality of flow paths for directing the cooling fluid from the elongated exit of the cooling circuit into the entrance at the wider end of the chamber; and an exit at a narrower end of the chamber, the exit including an opening to a single exhaust passageway from the substantially concave chamber, all of the cooling fluid passing out of the chamber through the single exhaust passageway;

wherein the chamber includes a pair of opposing side walls and a pair of opposing ramped walls, the opposing ramped walls extending between the pair of opposing side walls from the entrance at the end wider end of the chamber to the narrower end of the chamber adjacent the opening to the single exhaust passageway, wherein the chamber has a decreasing cross-sectional area from the entrance at the wider end of the chamber to the exit at the narrower end of the chamber;

wherein the plurality of flow paths flow into the entrance at the wider end of chamber along an axis substantially perpendicular to an axis of the chamber from the wider end of the chamber to the narrower end of the chamber and substantially parallel to the single exhaust passageway at the narrower end of the chamber.

6. The cooling fluid exhaust duct of claim 5, wherein the entrance of the chamber directs the cooling fluid entering thereto in substantial alignment with a substantially linear flow direction of the cooling fluid through the cooling circuit.

7. A cooling structure for a blade, the cooling structure comprising:

a cooling circuit in a portion of the blade;

a cooling fluid feed duct for the cooling circuit, the cooling fluid feed duct including a feed chamber having:

a feed entrance fluidly coupled to a cooling fluid source; and a feed exit to an elongated entrance to the cooling circuit, wherein the elongated entrance to the cooling circuit includes a plurality of flow path openings for directing the cooling fluid from the elongated entrance into the cooling circuit, wherein the plurality of flow path openings direct the cooling fluid into the cooling circuit along an axis substantially perpendicular to an axis of flow of the cooling fluid through the feed chamber, and wherein the feed exit includes a linear ramped wall for maintaining a flow velocity of the cooling fluid along the elongated entrance to the cooling circuit as the cooling fluid passes from the exit of the chamber into the cooling circuit through the plurality of flow path openings, wherein the ramped wall extends at least from a first end of the elongated entrance to a second end of the elongated entrance, wherein a distance from the ramped wall to a far side of the elongated entrance decreases in a direction of flow of the cooling fluid along the elongated entrance through the exit of the chamber; and a cooling fluid exhaust duct for the cooling circuit, the cooling fluid exhaust duct including a substantially concave exhaust chamber including an exhaust entrance at a wider end of the exhaust chamber and in fluid communication with an elongated exit from the cooling circuit, and an exhaust exit at a narrower end of the exhaust chamber, the exhaust exit including an opening to an exhaust passageway from the exhaust chamber.

8. The cooling structure of claim 7, wherein the feed chamber includes a pair of opposing side walls, the ramped wall extending between the pair of opposing side walls.

9. The cooling structure of claim 7, wherein the feed exit of the feed chamber directs the cooling fluid exiting therefrom through the plurality of flow path openings to substantially align with a substantially linear flow direction of the cooling fluid through the cooling circuit.

10. The cooling structure of claim 7, wherein the exhaust entrance has a first cross-sectional area and the exhaust exit has a decreasing cross-sectional area from the exhaust entrance to an end of the exhaust exit.

11. The cooling structure of claim 7, wherein the exhaust chamber extends along an axis substantially perpendicular to an axis of the cooling circuit.

12. The cooling structure of claim 7, wherein the exhaust chamber includes a pair of opposing side walls, and a pair of opposing ramped surfaces extending along the pair of opposing side walls.

13. The cooling structure of claim 7, wherein the exhaust entrance of the exhaust chamber directs the cooling fluid entering thereto in substantially alignment with a substantially linear flow direction of the cooling fluid through the cooling circuit.

* * * * *